US011684164B2

(12) United States Patent
Wang et al.

(10) Patent No.: US 11,684,164 B2
(45) Date of Patent: Jun. 27, 2023

(54) ADJUSTABLE BED WITH SLIDABLE ASSEMBLIES

(71) Applicant: Nisco Co., Ltd, Jiangsu (CN)

(72) Inventors: Wei Wang, Jiangsu (CN); Jian Xie, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 249 days.

(21) Appl. No.: 17/233,758

(22) Filed: Apr. 19, 2021

(65) Prior Publication Data

US 2021/0321785 A1 Oct. 21, 2021

Related U.S. Application Data

(60) Provisional application No. 63/013,073, filed on Apr. 21, 2020.

(51) Int. Cl.
*A47C 20/04* (2006.01)
*A47C 21/00* (2006.01)

(52) U.S. Cl.
CPC ..... *A47C 20/041* (2013.01); *A47C 21/00* (2013.01)

(58) Field of Classification Search
USPC ..... 5/618
See application file for complete search history.

(56) References Cited

U.S. PATENT DOCUMENTS 3,593,350 A * 7/1971 Knight ..... A47C 20/041 5/616
3,760,436 A * 9/1973 Zach ..... A47C 21/00 5/103
3,982,741 A * 9/1976 Mitchell ..... A61G 7/015 5/614
4,104,749 A * 8/1978 Grundler ..... A47C 20/041 5/616
4,376,316 A * 3/1983 Mercier ..... A47C 20/041 5/616
4,527,914 A * 7/1985 McLaughlin ..... A61G 7/002 384/154
4,970,737 A * 11/1990 Sagel ..... A47C 20/08 5/616
5,165,129 A * 11/1992 Rohm ..... A61G 7/015 5/616

(Continued)

*Primary Examiner* — David R Hare
*Assistant Examiner* — Luke Hall
(74) *Attorney, Agent, or Firm* — Locke Lord LLP; Tim Tingkang Xia, Esq.

(57) ABSTRACT

An adjustable bed includes a head frame assembly, a first slidable assembly having a slidable assembly base and slidable assembly sides slidable within lower C steel brackets; head lift arm bracket assemblies pivotally connected to the slidable assembly sides; and a head lift platform mounted on the head lift arm bracket assemblies, an upper seat platform mounted on the first slidable assembly, and a lower seat platform movably attached onto the higher C steel bracket; a second slidable assembly with a spacing bracket having a guiding slot mounted on the slidable assembly base and the fixing bracket being mounted on the lower seat platform, and the connecting bolt mounted on the fixing bracket and received in the guiding slot; and a head lift motor secured to the head frame assembly for operably driving the head lift arm bracket assemblies in head lift forward or backward direction.

15 Claims, 14 Drawing Sheets

(56) References Cited

U.S. PATENT DOCUMENTS 5,257,428 A * 11/1993 Carroll ..... A47C 19/122 5/618
5,461,740 A * 10/1995 Pearson ..... A61G 7/012 5/607
6,000,076 A * 12/1999 Webster ..... A61G 7/0524 5/616
6,101,647 A * 8/2000 Stroud ..... A47C 20/041 5/915
6,216,295 B1 * 4/2001 Pearson ..... A61G 7/002 5/616
6,276,011 B1 * 8/2001 Antinori ..... A47C 20/08 5/613
6,320,510 B2 * 11/2001 Menkedick ..... A61G 7/0524 5/624
6,421,854 B1 * 7/2002 Heimbrock ..... A61G 7/0528 5/601
6,826,793 B2 * 12/2004 Tekulve ..... A61G 7/015 5/81.1 R
6,862,762 B1 * 3/2005 Johnson ..... A61G 7/005 5/601
6,880,189 B2 * 4/2005 Welling ..... A61G 7/0513 5/624
7,559,102 B1 * 7/2009 Benzo ..... A61G 7/07 5/617
7,886,379 B2 * 2/2011 Benzo ..... A61G 7/008 5/613
8,938,827 B2 * 1/2015 Shimada ..... A61G 7/015 5/613
10,682,272 B2 * 6/2020 Bellingroth ..... A47C 20/041
10,912,391 B2 2/2021 Wang et al.
2007/0289064 A1 * 12/2007 Martin ..... A61G 5/1083 5/618
2009/0019640 A1 * 1/2009 Neuenswander ..... A61G 7/015 5/618
2009/0070928 A1 * 3/2009 Huang ..... A61G 7/012 5/11
2009/0178201 A1 * 7/2009 Lujan ..... A61G 7/07 5/630
2009/0211028 A1 * 8/2009 Richmond ..... A47C 20/08 5/717
2010/0005592 A1 * 1/2010 Poulos ..... A61G 7/0509 5/613
2010/0186168 A1 * 7/2010 Harrison ..... A47C 20/041 5/616
2010/0199433 A1 * 8/2010 Clenet ..... A61G 7/018 5/618
2012/0036636 A1 * 2/2012 Stryker ..... A61G 7/0506 5/600
2014/0201915 A1 * 7/2014 Ermalovich ..... F16B 12/60 29/434
2014/0215717 A1 * 8/2014 Rigsby ..... A61G 7/0513 5/613
2015/0096815 A1 * 4/2015 Ottenweller ..... A61G 7/0528 180/19.1
2015/0107024 A1 * 4/2015 Xu ..... A47C 20/041 5/616
2015/0121623 A1 * 5/2015 Huang ..... A61G 7/018 5/616
2015/0135436 A1 * 5/2015 Stryker ..... A61G 7/018 5/600
2015/0297432 A1 * 10/2015 Poulos ..... A61G 5/14 5/613
2016/0128883 A1 * 5/2016 Robertson ..... A47C 7/50 5/613
2016/0136021 A1 * 5/2016 Roussy ..... A61G 7/018 5/611
2017/0071356 A1 * 3/2017 Xu ..... A47C 20/041
2017/0202718 A1 * 7/2017 Lo ..... A61G 7/0755
2018/0103770 A1 * 4/2018 Nava ..... A61G 7/015
2018/0110340 A1 * 4/2018 Rawls-Meehan ..... A47C 20/04
2018/0125249 A1 * 5/2018 Chung ..... A47C 19/021
2018/0125252 A1 * 5/2018 Chung ..... A47C 20/04
2018/0132626 A1 * 5/2018 He ..... A47C 20/041
2018/0338625 A1 * 11/2018 Nava ..... A47C 19/021
2020/0022504 A1 * 1/2020 Zhang ..... A47C 20/041
2020/0100961 A1 * 4/2020 Zeng ..... A61G 7/018
2020/0107980 A1 * 4/2020 Cutler ..... A61G 7/018
2020/0214460 A1 * 7/2020 Wang ..... A47C 21/006
2020/0214461 A1 * 7/2020 Wang ..... A47C 20/08

* cited by examiner

ADJUSTABLE BED WITH SLIDABLE ASSEMBLIES

CROSS-REFERENCE TO RELATED PATENT APPLICATION

This application claims priority to and the benefit of, pursuant to 35 U.S.C. § 119(e), U.S. provisional patent application Ser. No. 63/013,073, filed Apr. 21, 2020, which is incorporated herein in its entirety by reference.

FIELD OF THE INVENTION

The invention generally relates to a bed, and more particular to an adjustable bed with slidable assemblies.

BACKGROUND OF THE INVENTION

Beds find widespread use. Adjustable beds are used more and more in healthcare, home improvement scenarios. Recently, electric motors have been applied to adjustable beds to facilitate the movement through the different positions. For such a design, when an upper portion of an adjustable bed is lifted, the person who is lying on the adjustable bed may feel that his/her abdomen is pressed because the length of the adjustable bed is fixed when the upper portion is lifted.

Therefore, a heretofore unaddressed need exists in the art to address the aforementioned deficiencies and inadequacies.

SUMMARY OF THE INVENTION

The invention, in one aspect, relates to an adjustable bed with first and second slidable assemblies. The adjustable bed comprises a head frame assembly, having a head frame upper rail, a head frame lower rail, and a pair of head frame side rails, each head frame side rail having a lower C steel bracket at a upper end and a higher C steel bracket at a lower end, and the higher C steel bracket having an oblong hole formed on its top; a first slidable assembly having a slidable assembly base and a pair of slidable assembly sides, each of the pair of slidable assembly sides being slidable within one of the pair of lower C steel brackets in a slidable assembly upward direction or a slidable assembly downward direction; a pair of head lift arm bracket assemblies, an lower end of each head lift arm bracket assembly being pivotally connected to one of the pair of slidable assembly sides; and a head lift platform mounted on the pair of head lift arm bracket assemblies, an upper seat platform mounted on the first slidable assembly, and a lower seat platform attached onto the higher C steel bracket of one of the pair of head frame side rails by a mounting bolt through the oblong hole such that the lower seat platform is movable relatively to the higher C steel bracket along the slidable assembly upward direction or the slidable assembly downward direction; and at least one second slidable assembly having a spacing bracket, a fixing bracket and a connecting bolt, the spacing bracket having an upper end portion mounted on the slidable assembly base of the first slidable assembly and an lower end portion having a guiding slot formed therein, and the fixing bracket being mounted on the lower seat platform, and the connecting bolt being mounted on the fixing bracket and received in the guiding slot of the spacing bracket; and a head lift motor secured to the head frame assembly for operably driving the pair of head lift arm bracket assemblies in a head lift forward direction or a head lift backward direction. When the head lift motor drives the pair of head lift arm bracket assemblies in the head lift forward direction, the first slidable assembly slides in the slidable assembly upward direction, and when the head lift motor drives the pair of head lift arm bracket assemblies in the head lift backward direction, the first slidable assembly slides in the slidable assembly downward direction.

In one embodiment, when the head lift motor drives the pair of head lift arm bracket assemblies in the head lift forward direction, the first slidable assembly slides in the lower C steel bracket in the slidable assembly upward direction to lift the head lift platform, and the spacing bracket of the second slidable assembly co-moves with the first slidable assembly in the slidable assembly upward direction such that the connecting bolt of the second slidable assembly is positioned from an upper end to an lower end of the guiding slot of the spacing bracket, and the mounting bolt is positioned from a lower end to an upper end of the oblong hole, and the upper seat platform and the lower seat platform are separated by a gap.

In one embodiment, when the head lift motor drives the pair of head lift arm bracket assemblies in the head lift backward direction, the first slidable assembly slides in the lower C steel bracket in the slidable assembly downward direction to put down the head lift platform, and the spacing bracket of the second slidable assembly co-moves with the first slidable assembly in the slidable assembly downward direction such that the connecting bolt of the second slidable assembly is positioned from the lower end to the upper end of the guiding slot of the spacing bracket, and the mounting bolt is positioned from the upper end to the lower end of the oblong hole, and the upper seat platform and the lower seat platform are closed to each other.

In one embodiment, the adjustable bed further comprises a support platform being mounted on the slidable assembly base of the first slidable assembly so that the support platform operably co-moves with the first slidable assembly. The support platform is beneath the upper seat platform and the lower seat platform.

In one embodiment, the adjustable bed further comprises a head support tube having an upper end pivotally connected to the head frame upper rail of the head frame assembly and a lower end connected to the head lift platform.

In one embodiment, the adjustable bed further comprises a head tilt platform pivotally connected to the head lift platform; and a head tilt motor secured to the head lift platform for driving the head tilt platform in a head tilt forward direction or a head tilt backward direction.

In one embodiment, the adjustable bed further comprises one or more of a first opening in the lower seat platform to accommodate the head lift motor, and a second opening in the head lift platform to accommodate the head tilt motor.

In one embodiment, the adjustable bed further comprises a first massage motor opening hole in the head lift platform to accommodate a massage motor.

In one embodiment, the adjustable bed further comprises a plurality of rolling wheels attached to the pair of slidable assembly sides to roll within one of the pair of lower C steel brackets in the slidable assembly upward direction or the slidable assembly downward direction.

In one embodiment, the adjustable bed further comprises a foot frame assembly, having a foot frame upper rail, a foot frame lower rail, and a pair of foot frame side rails; and a knockdown connecting bracket connecting the head frame lower rail of the head frame assembly and the foot frame upper rail of the foot frame assembly.

In one embodiment, the adjustable bed further comprises a pair of foot lift arm bracket assemblies, each foot lift arm bracket assembly having a first end pivotally connected to the foot frame assembly and a second end; a fixed platform mounted on the pair of foot frame side rails; a thigh platform mounted on the pair of foot lift arm bracket assemblies; a leg platform, hinged with the thigh platform through a hinge; a foot lift motor secured to the foot frame assembly for driving the pair of foot lift arm bracket assemblies in a foot lift forward direction or a foot lift backward direction; and a foot support tube having an upper end pivotally connected to the foot frame assembly and a lower end connected to the leg platform.

In one embodiment, the second end of each foot lift arm bracket assembly is provided with a roller for moveably supporting the thigh platform.

In one embodiment, each of the pair of foot frame side rails has a higher C steel bracket.

In one embodiment, the adjustable bed further comprises one or more of a third opening in the leg platform and a fifth opening in the thigh platform to accommodate the foot lift motor.

In one embodiment, the adjustable bed further comprises a second massage motor opening hole in the leg platform to accommodate a massage motor.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
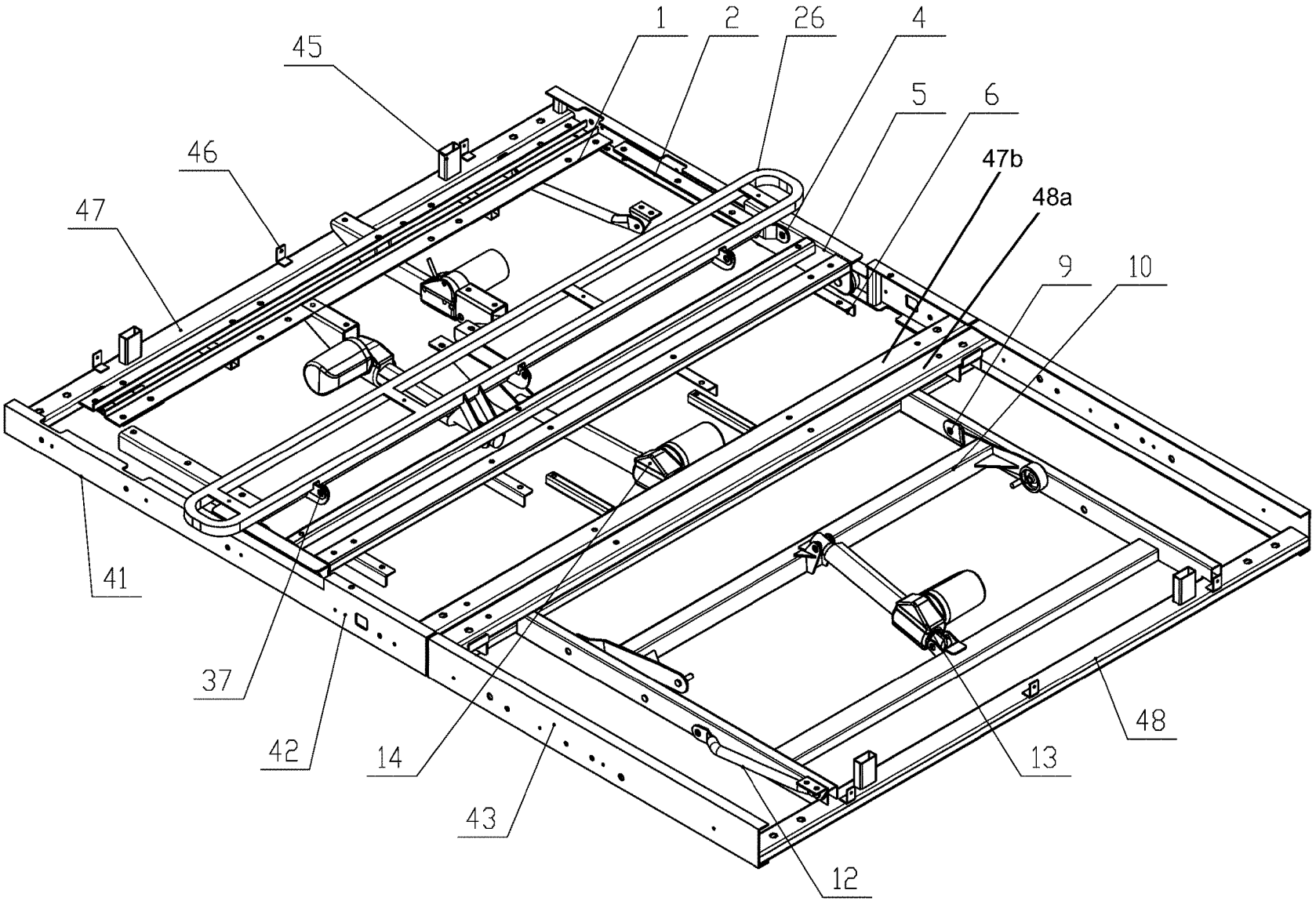
FIG. 1 shows schematically a front perspective view of a structural frame of an adjustable bed according to one embodiment of the invention.
Figure 2:
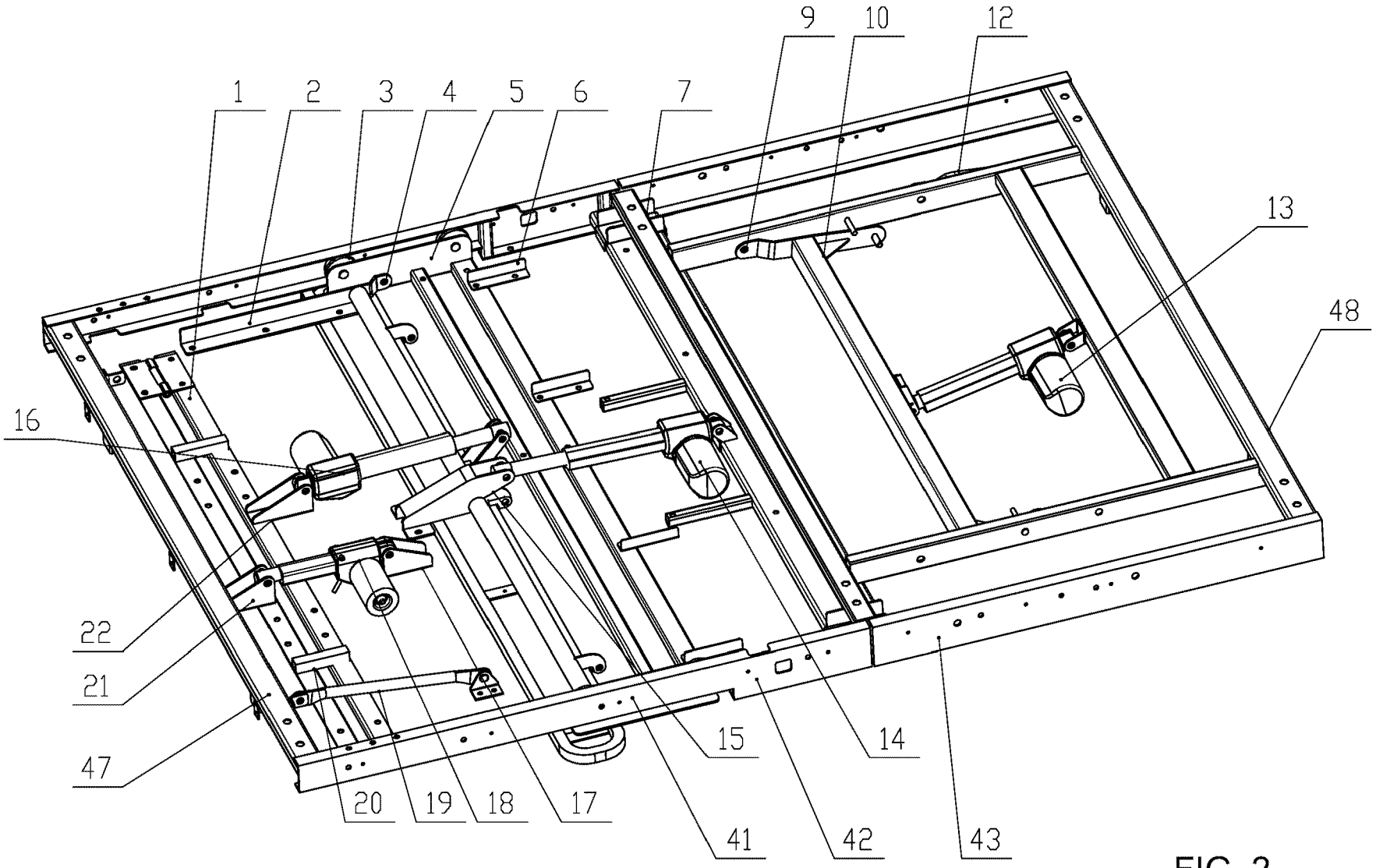
FIG. 2 shows schematically a back perspective view of the structural frame of the adjustable bed shown in FIG. 1.
Figure 3:
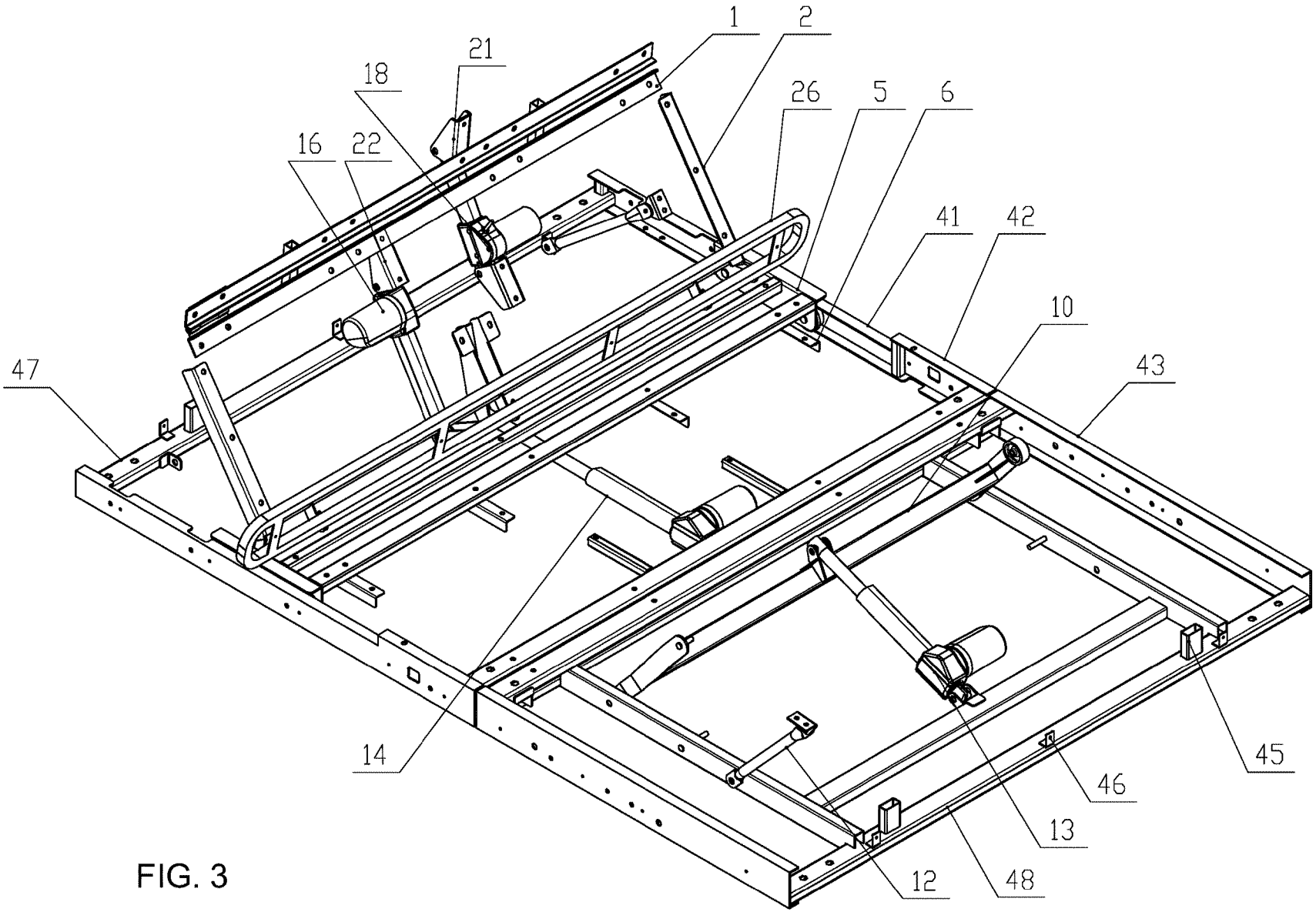
FIG. 3 shows schematically another front perspective view of the structural frame of the adjustable bed shown in FIG. 1.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about" "substantially" or "approximately" can be inferred if not expressly stated.

The description will be made as to the embodiments of the invention in conjunction with the accompanying drawings in FIGS. 1-14. In accordance with the purposes of this invention, as embodied and broadly described herein, this invention, in one aspect, relates to an adjustable bed.

According to one aspect of the invention, an adjustable bed includes a head frame assembly, having a head frame upper rail, a head frame lower rail, and a pair of head frame side rails, each head frame side rail having a lower C steel bracket at a upper end and a higher C steel bracket at a lower end, and the higher C steel bracket having an oblong hole formed on its top; a first slidable assembly having a slidable assembly base and a pair of slidable assembly sides, each of the pair of slidable assembly sides being slidable within one of the pair of lower C steel brackets in a slidable assembly upward direction or a slidable assembly downward direction; a pair of head lift arm bracket assemblies, an lower end of each head lift arm bracket assembly being pivotally connected to one of the pair of slidable assembly sides; and a head lift platform mounted on the pair of head lift arm bracket assemblies, an upper seat platform mounted on the first slidable assembly, and a lower seat platform attached onto the higher C steel bracket of one of the pair of head frame side rails by a mounting bolt through the oblong hole such that the lower seat platform is movable relatively to the higher C steel bracket along the slidable assembly upward direction or the slidable assembly downward direction; and at least one second slidable assembly having a spacing bracket, a fixing bracket and a connecting bolt, the spacing bracket having an upper end portion mounted on the slidable assembly base of the first slidable assembly and an lower end portion having a guiding slot formed therein, and the fixing bracket being mounted on the lower seat platform, and the connecting bolt being mounted on the fixing bracket and received in the guiding slot of the spacing bracket; and a head lift motor secured to the head frame assembly for operably driving the pair of head lift arm bracket assemblies in a head lift forward direction or a head lift backward direction. When the head lift motor drives the pair of head lift arm bracket assemblies in the head lift forward direction, the first slidable assembly slides in the slidable assembly upward direction, and when the head lift motor drives the pair of head lift arm bracket assemblies in the head lift backward direction, the first slidable assembly slides in the slidable assembly downward direction.

In certain embodiments, when the head lift motor drives the pair of head lift arm bracket assemblies in the head lift forward direction, the first slidable assembly slides in the lower C steel bracket in the slidable assembly upward direction to lift the head lift platform, and the spacing bracket of the second slidable assembly co-moves with the first slidable assembly in the slidable assembly upward direction such that the connecting bolt of the second slidable assembly is positioned from an upper end to an lower end of the guiding slot of the spacing bracket, and the mounting bolt is positioned from a lower end to an upper end of the oblong hole, and the upper seat platform and the lower seat platform are separated by a gap.

In certain embodiments, when the head lift motor drives the pair of head lift arm bracket assemblies in the head lift backward direction, the first slidable assembly slides in the lower C steel bracket in the slidable assembly downward direction to put down the head lift platform, and the spacing bracket of the second slidable assembly co-moves with the first slidable assembly in the slidable assembly downward direction such that the connecting bolt of the second slidable assembly is positioned from the lower end to the upper end of the guiding slot of the spacing bracket, and the mounting bolt is positioned from the upper end to the lower end of the oblong hole, and the upper seat platform and the lower seat platform are closed to each other.

In certain embodiments, the adjustable bed further comprises a support platform being mounted on the slidable assembly base of the first slidable assembly so that the support platform operably co-moves with the first slidable assembly. The support platform is beneath the upper seat platform and the lower seat platform.

In certain embodiments, the adjustable bed further comprises a head support tube having an upper end pivotally connected to the head frame upper rail of the head frame assembly and a lower end connected to the head lift platform.

In certain embodiments, the adjustable bed further comprises a head tilt platform pivotally connected to the head lift platform; and a head tilt motor secured to the head lift platform for driving the head tilt platform in a head tilt forward direction or a head tilt backward direction.

In certain embodiments, the adjustable bed further comprises one or more of a first opening in the lower seat platform to accommodate the head lift motor, and a second opening in the head lift platform to accommodate the head tilt motor.

In certain embodiments, the adjustable bed further comprises a first massage motor opening hole in the head lift platform to accommodate a massage motor.

In certain embodiments, the adjustable bed further comprises a plurality of rolling wheels attached to the pair of slidable assembly sides to roll within one of the pair of lower C steel brackets in the slidable assembly upward direction or the slidable assembly downward direction.

In certain embodiments, the adjustable bed further comprises a foot frame assembly, having a foot frame upper rail, a foot frame lower rail, and a pair of foot frame side rails; and a knockdown connecting bracket connecting the head frame lower rail of the head frame assembly and the foot frame upper rail of the foot frame assembly.

In certain embodiments, the adjustable bed further comprises a pair of foot lift arm bracket assemblies, each foot lift arm bracket assembly having a first end pivotally connected to the foot frame assembly and a second end; a fixed platform mounted on the pair of foot frame side rails; a thigh platform mounted on the pair of foot lift arm bracket assemblies; a leg platform, hinged with the thigh platform through a hinge; a foot lift motor secured to the foot frame assembly for driving the pair of foot lift arm bracket assemblies in a foot lift forward direction or a foot lift backward direction; and a foot support tube having an upper end pivotally connected to the foot frame assembly and a lower end connected to the leg platform.

In certain embodiments, the second end of each foot lift arm bracket assembly is provided with a roller for moveably supporting the thigh platform.

In certain embodiments, each of the pair of foot frame side rails has a higher C steel bracket.

In certain embodiments, the adjustable bed further comprises one or more of a third opening in the leg platform and a fifth opening in the thigh platform to accommodate the foot lift motor.

In certain embodiments, the adjustable bed further comprises a second massage motor opening hole in the leg platform to accommodate a massage motor.

Referring to FIGS. 1-8, an adjustable bed is shown according to first embodiment of the invention. In this exemplary embodiment, the adjustable bed includes a head frame assembly 47, a foot frame assembly 48 and a knockdown connecting bracket 7. Specifically, the head frame assembly 47 includes a head frame upper rail, a head frame lower rail, and a pair of head frame side rails. The pair of head frame side rails being transversely spaced and longitudinally extended and being parallel to each other, and the head frame upper rail and the head frame lower rail 47*b* being longitudinally spaced and transversely extended. Each head frame side rail has upper and lower ends. Two ends of the head frame upper rail are rigidly connected to the upper ends of the pair of head frame side rails, respectively, and two ends of the head frame lower rail are rigidly connected to the lower ends of the pair of side rails, respectively. As such the head frame upper rail and the head frame lower rail and the pair of head frame side rails are co-planar in a rectangle form. Each head frame side rail has a lower C steel bracket 41 at the upper end portion and a higher C steel bracket 42 at the lower end portion. The higher C steel bracket 42 extends from the lower C steel bracket 41 and forms a step with the lower C steel bracket 41. The adjustable bed further includes at least one L bracket 46 mounted on the head frame upper rail. As used in the disclosure, the term "C steel bracket" refers to a groove type rail with a long, narrow cut or depression, especially a rail made to guide motion or receive a corresponding member.

The foot frame assembly 48 has a foot frame upper rail, a foot frame lower rail, and a pair of foot frame side rails. The pair of foot frame side rails being transversely spaced and longitudinally extended and being parallel to each other, and an foot frame upper rail and a foot frame lower rail being longitudinally spaced and transversely extended. Each foot frame side rail has upper and lower ends. Two ends of the foot frame upper rail are rigidly connected to the upper ends of the pair of foot frame side rails, respectively, and two ends of the foot frame lower rail are rigidly connected to the lower ends of the pair of side rails, respectively. As such the foot frame upper rail and the foot frame lower rail and the pair of foot frame side rails are co-planar in a rectangle form. In one embodiment, each of the pair of foot frame side rails has a higher C steel bracket 43.

Figure 8:
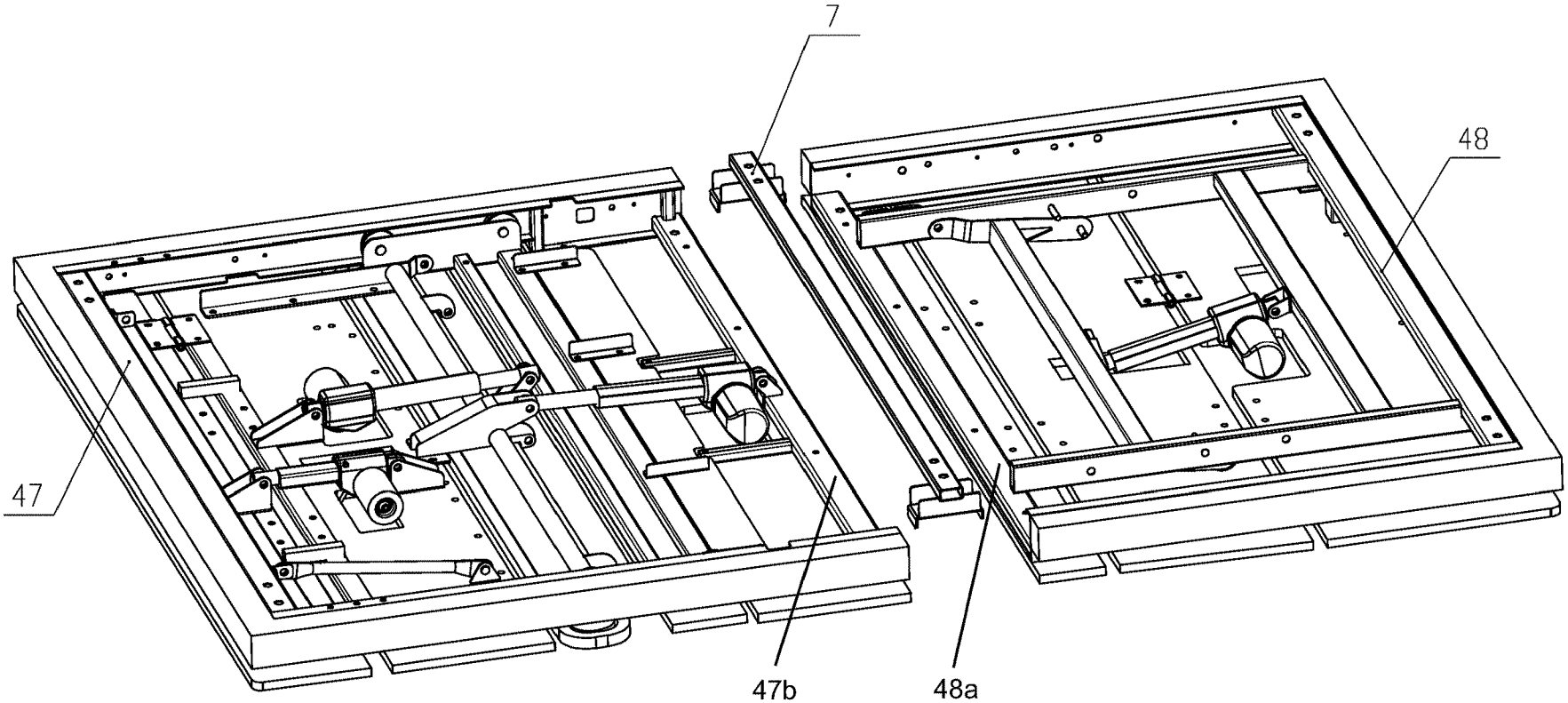
FIG. 8 shows schematically yet another back perspective view of the adjustable bed shown in FIG. 4.

The knockdown connecting bracket 7 connects the head frame lower rail 47*b* of the head frame assembly 47 and the foot frame upper rail 48*a* of the foot frame assembly 48, as shown in FIG. 8. In this way, the adjustable bed is easy to assemble and transport.

The adjustable bed further includes a slidable assembly 5. The slidable assembly 5 includes a slidable assembly base and a pair of slidable assembly sides. Each of the pair of slidable assembly sides is slidable within one of the pair of lower C steel brackets 41 in a slidable assembly upward direction (i.e., slides toward the head frame upper rail) or a slidable assembly downward direction (i.e., slides toward the head frame lower rail). In one embodiment, a plurality of rolling wheels 3 are mounted at the pair of slidable assembly sides to roll within one of the pair of lower C steel brackets 41 in the slidable assembly upward direction or the slidable assembly downward direction. In one embodiments, the number of rolling wheels 3 mounted at each slidable assembly side is two. It should be noted that other number of rolling wheels 3 mounted at each slidable assembly side could be any other number (e.g., one, three, eight, etc.).

A plurality of slidable assembly angle steels are mounted on the slidable assembly base. In one embodiment, the number of slidable assembly angle steels mounted on the slidable assembly base is four. It should be noted that other number of slidable assembly angle steels mounted on the slidable assembly base could be any other number (e.g., one, two, six, etc.).

The adjustable bed further includes a pair of head lift arm bracket assemblies 2. A first end of each head lift arm bracket assembly 2 is pivotally connected to one of the pair of slidable assembly sides through one of a pair of rotate pivots 4. A second end of each head lift arm bracket assembly 2 is connected to one of two ends of a first head tilt angle bracket 1. A second head tilt angle bracket 1 is hinged with the first head tilt angle bracket 1 through a hinge 11.

The adjustable bed further includes a head tilt platform 23, a head lift platform 24, a lumbar lift bracket assembly 26, an upper seat platform 27, a support platform 44 and a lower seat platform 28. The head tilt platform 23 is mounted on the second head tilt angle bracket 1. The head lift platform 24 is mounted on the first head tilt angle bracket 1 and the pair of head lift arm bracket assemblies 2. Because the second head tilt angle bracket 1 is hinged with the first head tilt angle bracket 1 through the hinge 11, the head tilt platform 23 can rotate relative to the head lift platform 24.

The lumbar lift bracket assembly 26 is pivotally connected to the pair of head lift arm bracket assemblies 2 through a pair of rotate pivots 37. The upper seat platform 27 is mounted on the slidable assembly 5. The support platform 44 is mounted on the plurality of slidable assembly angle steels 6. The lower seat platform 28 is mounted on the higher C steel brackets 42 of the pair of head frame side rails. In terms of height, the support platform 44 is beneath the lower seat platform 28.

The adjustable bed further includes a head support tube/bar 19. The head support tube 19 has an upper end pivotally connected to the L bracket 46 mounted on the head frame upper rail and a lower end connected to the head lift platform 24.

Figure 4:
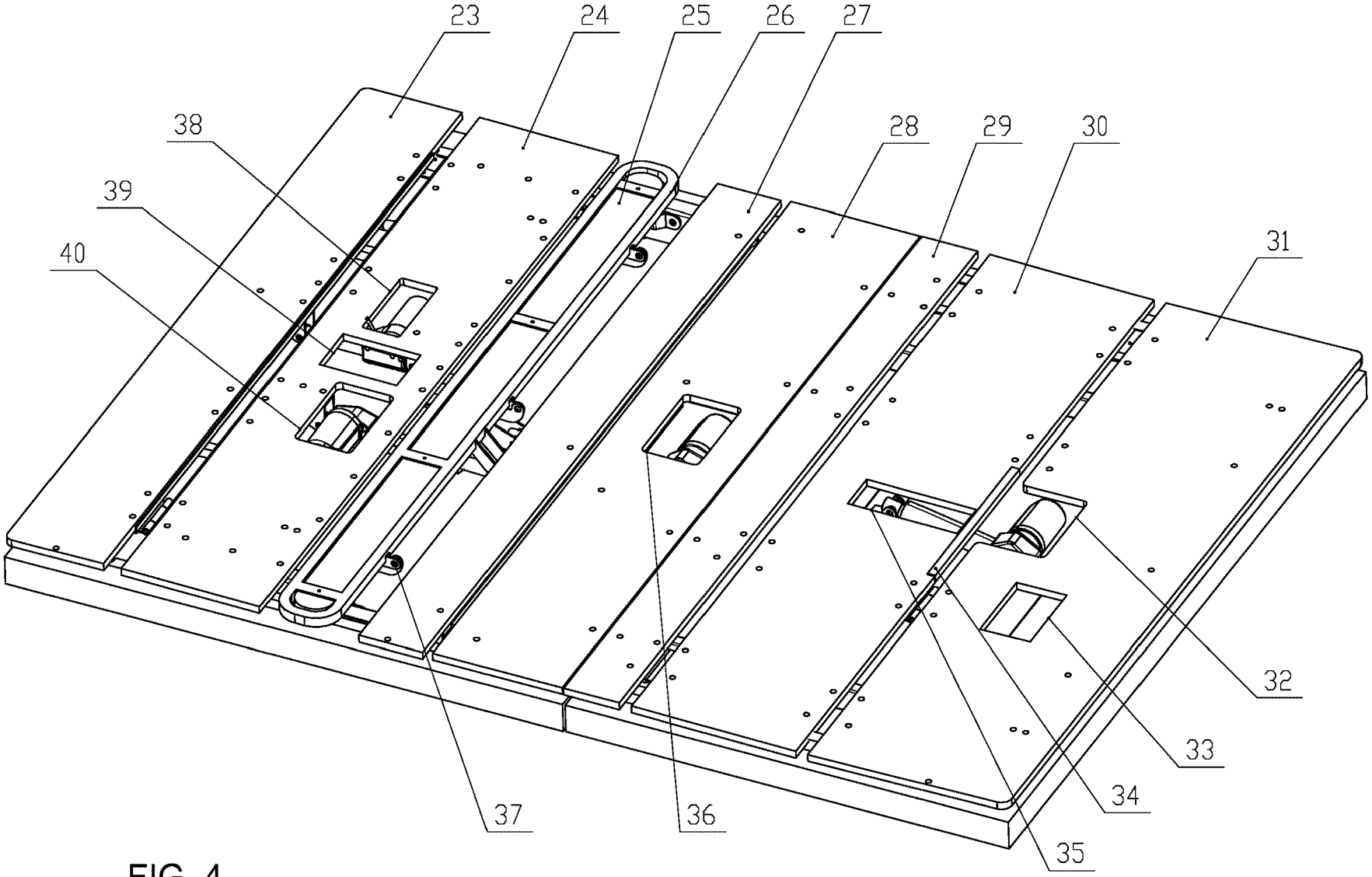
FIG. 4 shows schematically a front perspective view of an adjustable bed according to one embodiment of the invention.
Figure 5:
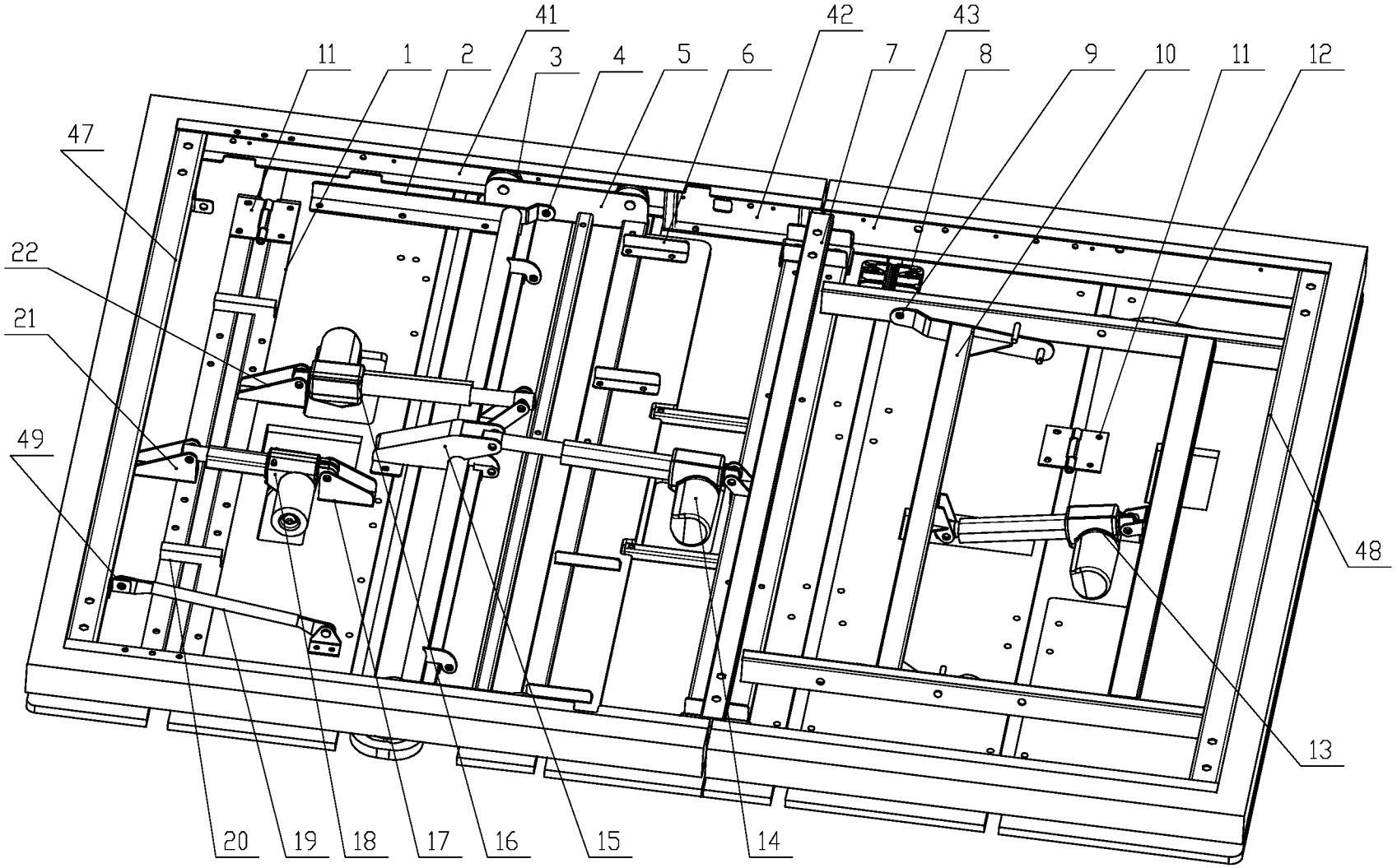
FIG. 5 shows schematically a back perspective view of the adjustable bed shown in FIG. 4.
Figure 6:
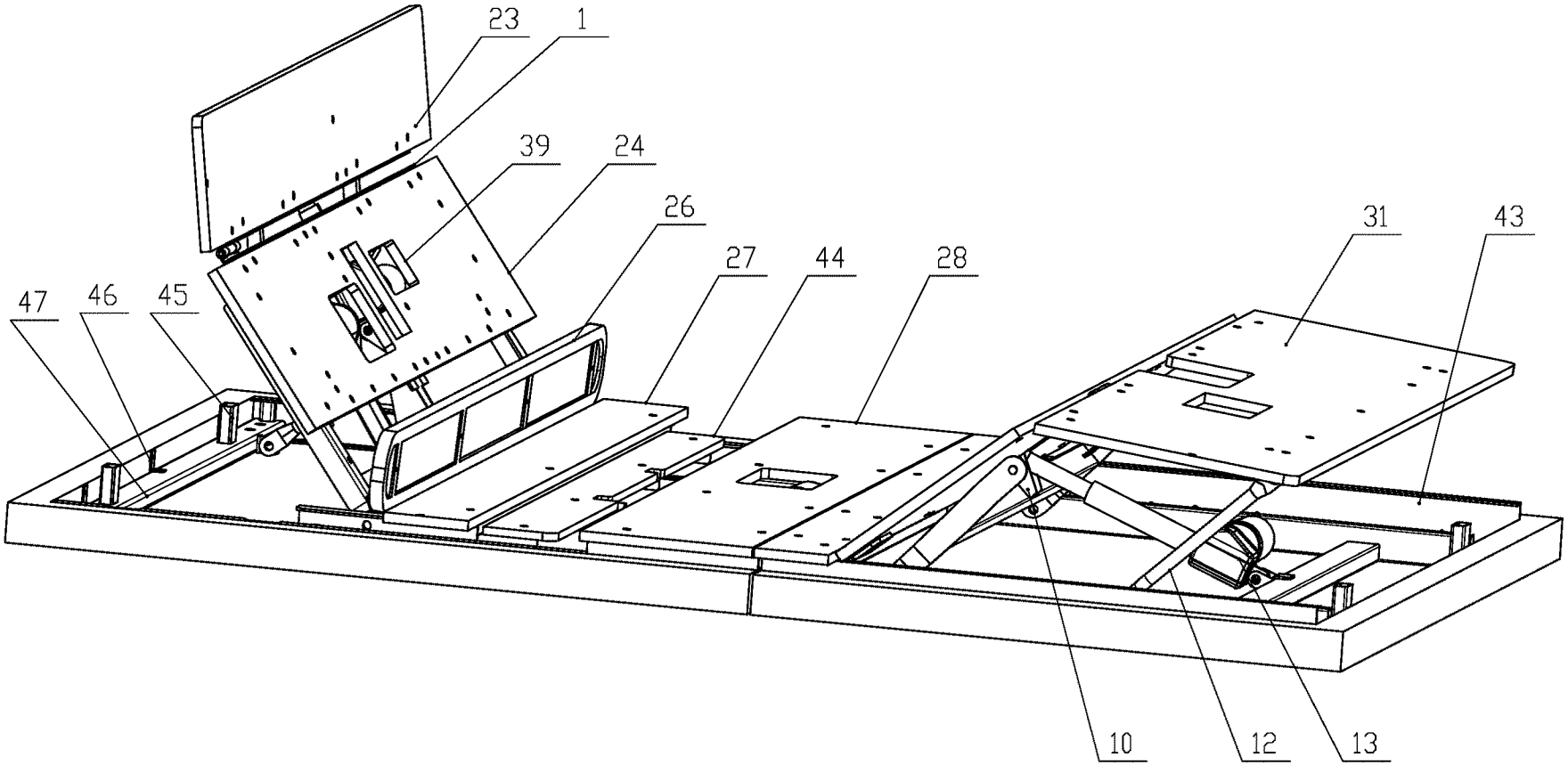
FIG. 6 shows schematically another front perspective view of the adjustable bed shown in FIG. 4.
Figure 7:
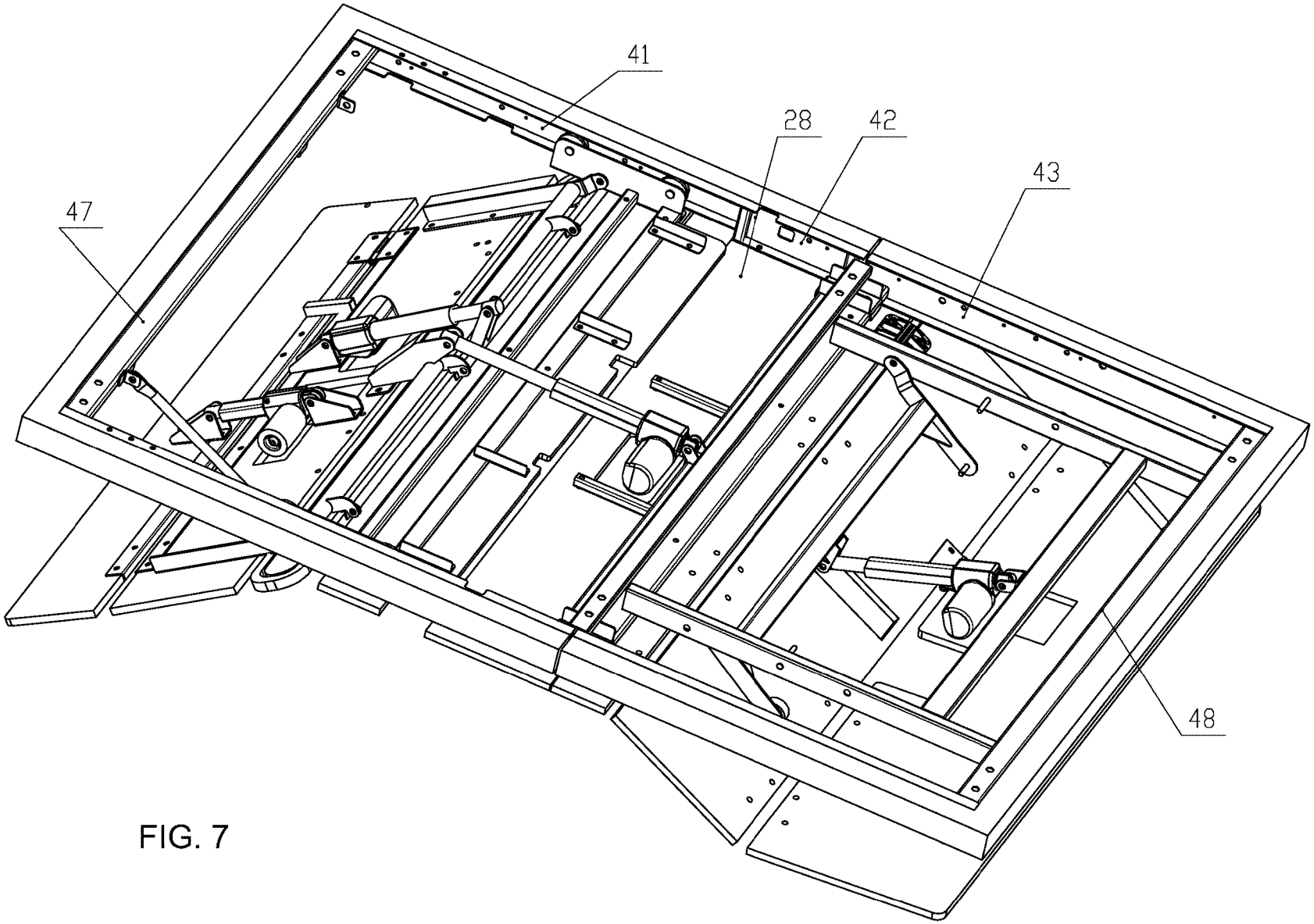
FIG. 7 shows schematically another back perspective view of the adjustable bed shown in FIG. 4.

The adjustable bed further includes a head lift motor 14. The head lift motor 14 is secured to the head frame assembly 47 for driving the pair of head lift arm bracket assemblies 2 in a head lift forward direction (i.e., the head lift arm bracket assemblies 2 are lifted, as shown in FIG. 6) or a head lift backward direction (i.e., the head lift arm bracket assemblies 2 are laid back, as shown in FIG. 4). In one embodiment, the head lift motor 14 is a linear actuator.

When the head lift motor 14 drives the pair of head lift arm bracket assemblies 2 in the head lift forward direction, because of the head support tube 19, the slidable assembly 5 slides in the slidable assembly upward direction. When the head lift motor 14 drives the pair of head lift arm bracket assemblies 2 in the head lift backward direction, because of the head support tube 19, the slidable assembly 5 slides in the slidable assembly downward direction and the support platform 44 is partially beneath the lower seat platform 28.

In other words, when the head lift motor 14 drives the pair of head lift arm bracket assemblies 2 in the head lift forward direction, the head lift platform 24 is lifted, and in the meantime, the upper seat platform 27 and the lower seat platform 28 are gradually separated, therefore extending the length of the adjustable bed. In one embodiment, the gap between the upper seat platform 27 and the lower seat platform 28 has a maximum width up to 12 inches, preferably, up to 6.5 inches in the slidable assembly upward direction. In other words, when the upper seat platform 27 and the lower seat platform 28 are separated to the preferably greatest extent, the gap between them has a width of 6.5 inches. In this way, the person who is lying on the adjustable bed will not feel that his/her abdomen is pressed because the length of the adjustable bed is extended when the upper portion is lifted. As the slidable assembly 5 slides in the slidable assembly upward direction, the support platform 44 slides as well for supporting the person when the upper seat platform 27 and the lower seat platform 28 are gradually separated.

On the other hand, when the head lift motor 14 drives the pair of head lift arm bracket assemblies 2 in the head lift backward direction, the head lift platform 24 is laid back, and in the meantime, the upper seat platform 27 and the lower seat platform 28 are gradually coming closer to each other. Because the support platform 44 is beneath the lower seat platform 28 in terms of height, the support platform 44 is partially beneath the lower seat platform 28. When the head lift motor 14 drives the pair of head lift arm bracket assemblies to a fully laid back position as shown in FIG. 4, the support platform 44 is entirely beneath the lower seat platform 28.

The adjustable bed may further include a lumbar motor 16. The lumbar motor 16 is secured to the head lift platform 24 for driving the lumbar lift bracket assembly 26 in a lumbar lift forward direction (i.e., the lumbar lift bracket assembly 26 is lifted, as shown in FIG. 6) or a lumbar lift backward direction (i.e., the lumbar lift bracket assembly 26 is laid back, as shown in FIG. 4). In this way, the person who is lying on the adjustable bed can adjust the lumbar lift bracket assembly 26 as he desires. In one embodiment, the lumbar motor 16 is a linear actuator.

The adjustable bed may further include a head tilt motor 18. The head tilt motor 18 is secured to the head lift platform 24 for driving the head tilt platform 23 in a head tilt forward direction (i.e., the head tilt platform 23 is lifted, as shown in FIG. 6) or a head tilt backward direction (i.e., the head tilt platform 23 is laid back, as shown in FIG. 4). In this way, the person who is lying on the adjustable bed can adjust the head tilt platform 23 as he/she desires. In one embodiment, the head tilt motor 18 is a linear actuator.

In one embodiment, a welded tube 20 is welded to the first head tilt angle bracket 1 and protrudes in parallel with the head lift platform 24 toward the second head tilt angle bracket 1. The welded tube 20 prevents the head tilt platform 23 from moving further in the head tilt backward direction when the head tilt platform 23 is in contact with the welded tube 20. In this way, the welded tube 20 reinforces the strength of the head tilt platform 23. In other embodiments, the number of welded tubes 20 may be any number larger than one (e.g., two, three, four, etc.).

The adjustable bed may further include a pair of foot lift arm bracket assemblies 10, a fixed platform 29, a thigh platform 30, a leg platform 31, a foot lift motor 13, and a foot support tube/bar 12. Each of the pair of foot lift arm bracket assemblies 10 has a first end which is pivotally connected to the foot frame assembly 48 through one of a pair of rotate pivots 9. A second end of each foot lift arm bracket assembly 10 is a free end. The fixed platform 29 is mounted on the pair of foot frame side rails. The thigh platform 30 is mounted on the pair of foot lift arm bracket assemblies 10. The leg platform 31 is hinged with the thigh platform 30 through a hinge 11. The foot lift motor 13 is secured to the foot frame assembly 48 for driving the pair of foot lift arm bracket assemblies 10 in a foot lift forward direction (i.e., the thigh platform 30 is lifted, as shown in FIG. 6) or a foot lift backward direction (i.e., the thigh platform 30 is laid back, as shown in FIG. 4). In one embodiment, the foot lift motor 13 is a linear actuator. The foot support tube 12 has an upper end pivotally connected to the foot frame assembly 48 and a lower end connected to the leg platform 31.

In one embodiment, the adjustable bed may further include a first opening for motor 36 in the lower seat platform 28 to accommodate the head lift motor 14; a second opening for the motor 38 in the head lift platform 24 to accommodate the head tilt motor 18; a third opening for the motor 40 in the head lift platform 24 to accommodate the lumbar motor 16; a fourth opening for motor 32 in the leg platform 31 to accommodate the foot lift motor 13; and a fifth opening for the motor 35 in the thigh platform 30 to accommodate the foot lift motor 13. When the adjustable bed is fully laid back (as shown in FIG. 4), the first opening for motor 36, the second opening for the motor 38, the third opening for the motor 40, the fourth opening for motor 32 and the fifth opening for the motor 35 accommodate the head lift motor 14, the head tilt motor 18, the lumbar motor 16 and the foot lift motor 13, therefore avoiding collision, increasing thrust angle and lowering the overall height of the adjustable bed.

In one embodiment, the adjustable bed may further include a first massage motor opening hole 39 in the head lift platform 24 and a second massage motor opening hole 33 in the leg platform 31. The a first massage motor opening hole 39 and the second massage motor opening hole 33 can be used for installing massage components as needed.

In one embodiment, the adjustable bed may further include a plurality of head support platform mounting brackets 45 mounted on the head frame upper rail of the head frame assembly 47. In one embodiment, the adjustable bed may further include a plurality of foot support platform mounting brackets 45 mounted on the foot frame lower rail of the foot frame assembly 48.

Figure 12:
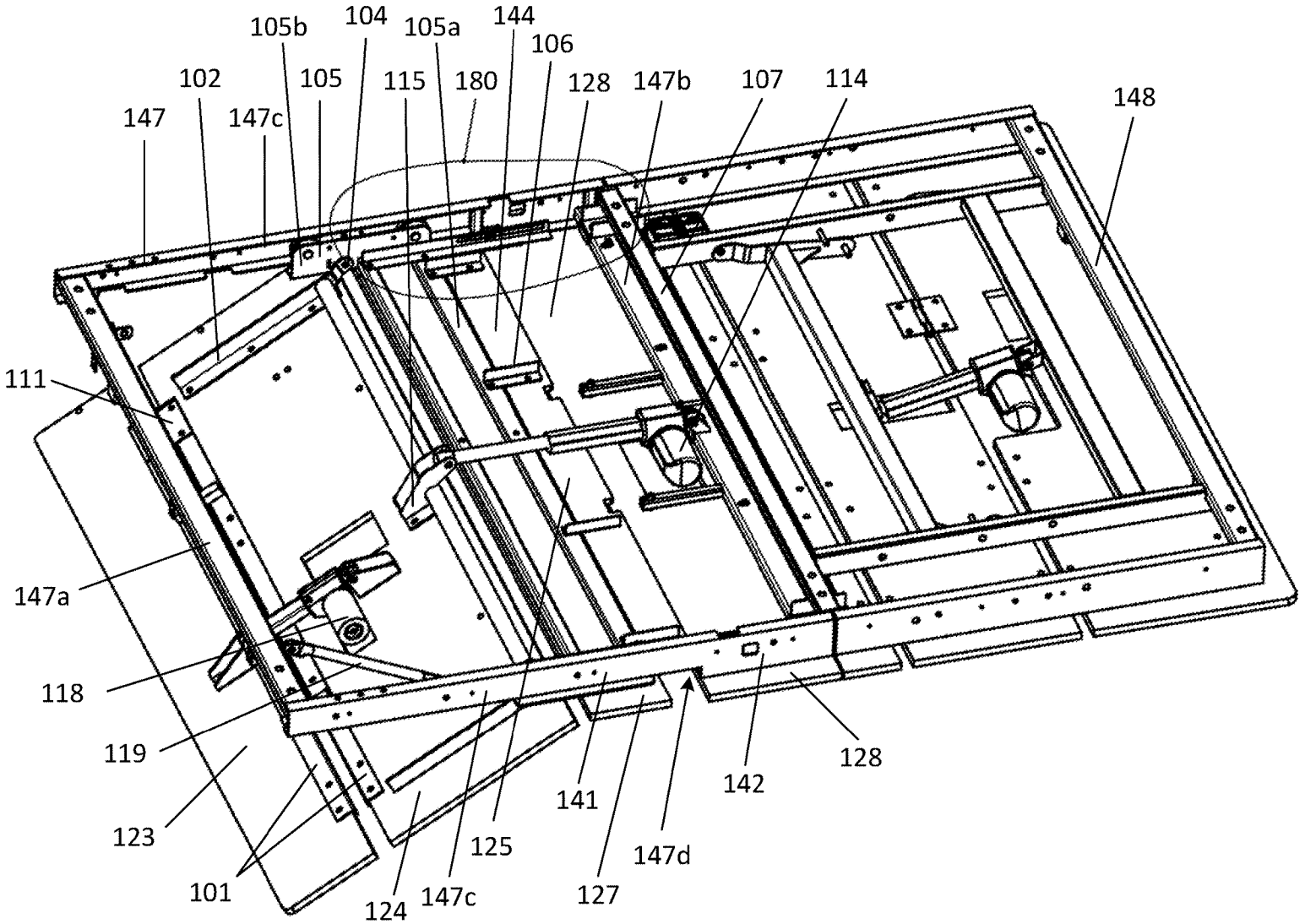
FIG. 12 shows schematically a back perspective view of the adjustable bed shown in FIG. 9.
Figure 13:
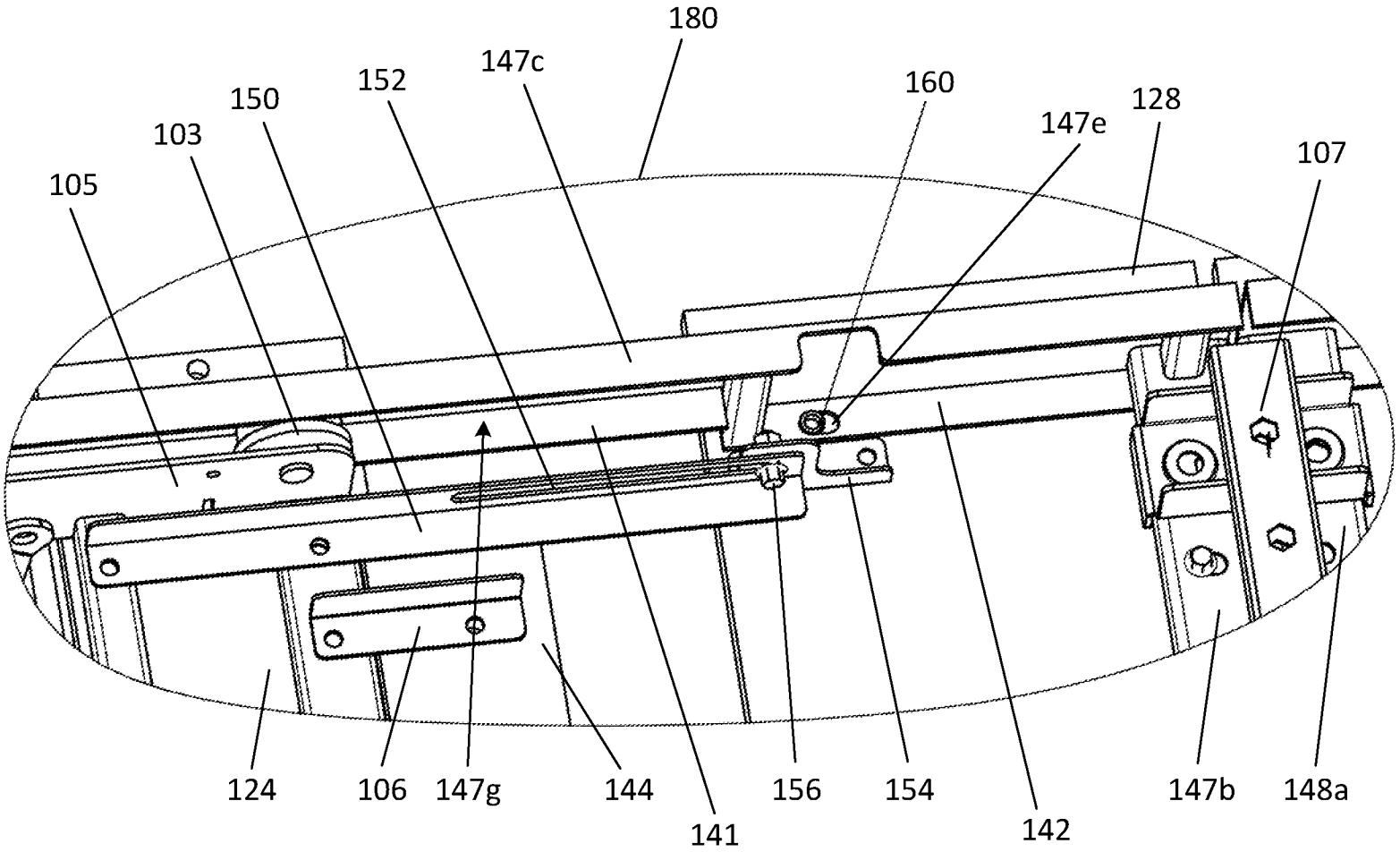
FIG. 13 shows schematically a partially back perspective view of the adjustable bed shown in FIG. 9.
Figure 14:
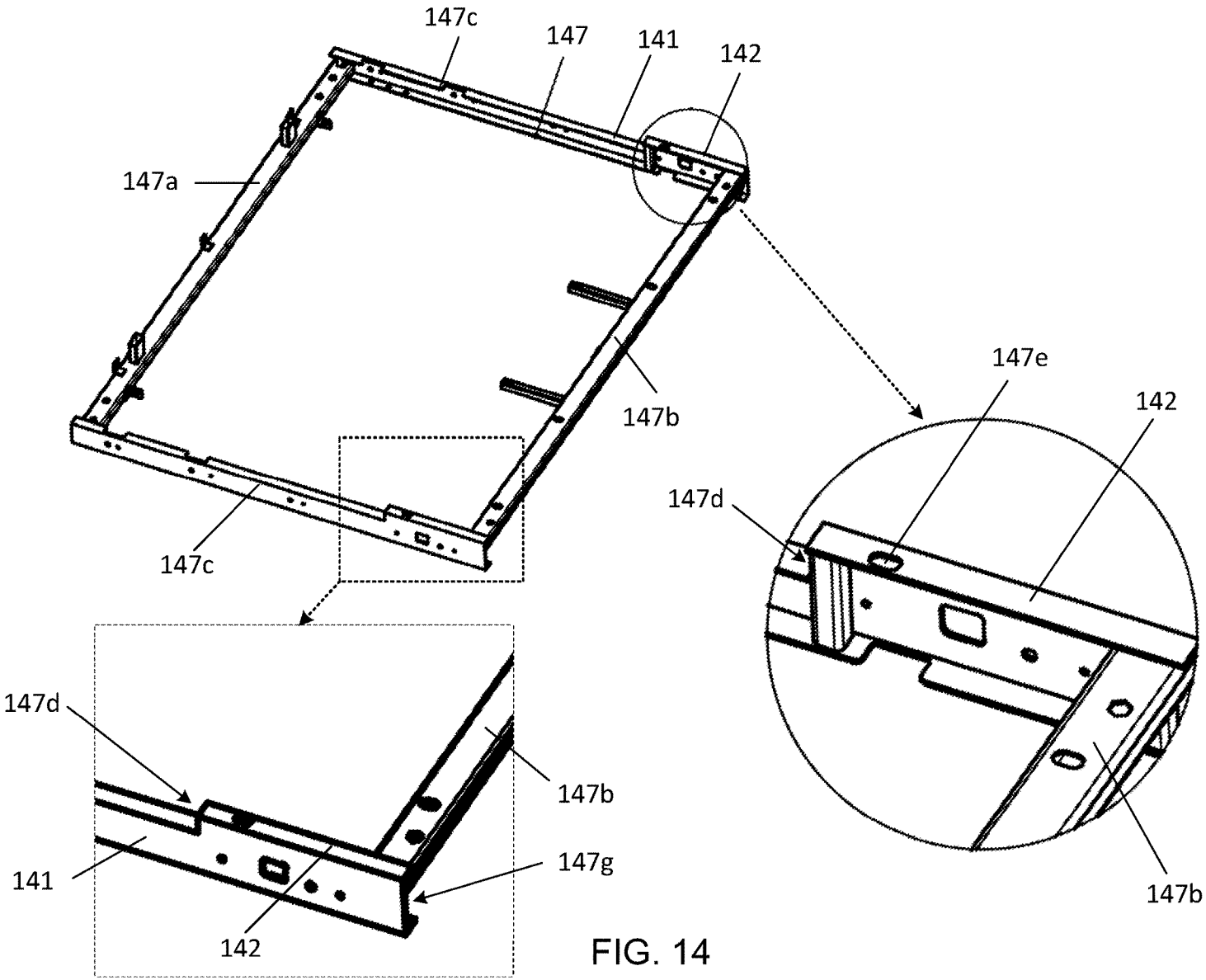
FIG. 14 shows schematically a perspective view of a head frame assembly of the adjustable bed shown in FIG. 9.

FIGS. 9-14 show another embodiment of the adjustable bed according to the invention. In this exemplary embodiment, the adjustable bed has the structures similar to the adjustable bed shown in FIGS. 1-8, and includes the adjustable bed includes a head frame assembly 147, a foot frame assembly 148 and a knockdown connecting bracket 107. Specifically, the head frame assembly 147 includes a head frame upper rail 147*a*, a head frame lower rail 147*b*, and a pair of head frame side rails 147*c*. The pair of head frame side rails 147*c* being transversely spaced and longitudinally extended and being parallel to each other, and the head frame upper rail 147*a* and the head frame lower rail 147*b* being longitudinally spaced and transversely extended. Each head frame side rail 147*c* has upper and lower ends. Two ends of the head frame upper rail are rigidly connected to the upper ends of the pair of head frame side rails, respectively, and two ends of the head frame lower rail 147*a* are rigidly connected to the lower ends of the pair of side rails 147*c*, respectively. As such the head frame upper rail 147*a* and the head frame lower rail 147*b* and the pair of head frame side rails 147*c* are co-planar in a rectangle form. Each head frame side rail 147*c* has a lower C steel bracket 141 at the upper end portion and a higher C steel bracket 142 at the lower end portion. The higher C steel bracket 142 extends from the lower C steel bracket 141 and forms a step 147*d* with the lower C steel bracket 141, as shown in FIG. 14. The adjustable bed further includes at least one L bracket 46 mounted on the head frame upper rail. As used in the disclosure, the term "C steel bracket" refers to a groove type rail with a long, narrow cut or depression, especially a rail made to guide motion or receive a corresponding member.

The foot frame assembly 148 has a foot frame upper rail 148*a* (FIG. 13), a foot frame lower rail, and a pair of foot frame side rails. The pair of foot frame side rails being transversely spaced and longitudinally extended and being parallel to each other, and the foot frame upper rail 148*a* and the foot frame lower rail being longitudinally spaced and transversely extended. Each foot frame side rail has upper and lower ends. Two ends of the foot frame upper rail are rigidly connected to the upper ends of the pair of foot frame side rails, respectively, and two ends of the foot frame lower rail are rigidly connected to the lower ends of the pair of side rails, respectively. As such the foot frame upper rail and the foot frame lower rail and the pair of foot frame side rails are co-planar in a rectangle form. In one embodiment, each of the pair of foot frame side rails has a higher C steel bracket 43. The operations of the foot frame assembly 148 are same as that of the foot frame assembly 48 disclosed above, and are not repeated herein.

The knockdown connecting bracket 107 connects the head frame lower rail 147*b* of the head frame assembly 147 and the foot frame upper rail 148*a* of the foot frame assembly 148, as shown in FIGS. 12-13. In this way, the adjustable bed is easy to assemble and transport.

The adjustable bed further includes a first slidable assembly 105 (see FIGS. 12-13). The first slidable assembly 105 includes a slidable assembly base 105*a* and a pair of slidable assembly sides 105*b* secured on two ends of the slidable assembly base 105*a*. Each of the pair of slidable assembly sides 105*b* is slidable within one of the pair of lower C steel brackets 141 (groove type 147*g*) in a slidable assembly upward direction (i.e., slides toward the head frame upper rail 147*a*) or a slidable assembly downward direction (i.e., slides toward the head frame lower rail 147*b*). In one embodiment, a plurality of rolling wheels 103 are mounted at the pair of slidable assembly sides 105*b* to roll within one of the pair of lower C steel brackets 141 in the slidable assembly upward direction or the slidable assembly downward direction. In one embodiments, the number of rolling wheels 103 mounted at each slidable assembly side 105*b* is two. It should be noted that other number of rolling wheels 103 mounted at each slidable assembly side 105*b* could be any other number (e.g., one, three, eight, etc.).

The adjustable bed further includes a pair of head lift arm bracket assemblies 102. A first end of each head lift arm bracket assembly 102 is pivotally connected to one of the pair of slidable assembly sides 105*b* of the first slidable assembly 105 through one of a pair of rotate pivots 104.

The adjustable bed further includes a head tilt platform 123, a head lift platform 124, an upper seat platform 127, a support platform 144 and a lower seat platform 128. The head tilt platform 123 and the head lift platform 124 are pivotally connected through the first and second head tilt angle brackets 101, as shown in FIG. 12, where the second head tilt angle bracket 101 is hinged with the first head tilt angle bracket 101 through a hinge 111. The head tilt platform 123 is mounted on the second head tilt angle bracket 101. The head lift platform 124 is mounted on the first head tilt angle bracket 101 and the pair of head lift arm bracket assemblies 102. Because the second head tilt angle bracket 101 is hinged with the first head tilt angle bracket 110 through the hinge 111, the head tilt platform 123 can rotate relative to the head lift platform 124.

The upper seat platform 127 is mounted on the first slidable assembly 105, so that the upper seat platform 127 is movable in accordance with the position of the first slidable assembly 105. The support platform 144 is connected to the slidable assembly base 105*a* of the first slidable assembly 105 through the plurality of slidable assembly angle steels 106, so that the support platform 144 is also co-moving with the first slidable assembly 105. The lower seat platform 128 is attached onto the higher C steel brackets 142 of the pair of head frame side rails 147*c*. In terms of height, the support platform 144 is beneath the upper seat platform 127 and the lower seat platform 128.

The adjustable bed further includes a head support tube/bar 119. The head support tube 119 has an upper end pivotally connected to the head frame upper rail 147*a* and a lower end connected to the head lift platform 124.

Figure 9:
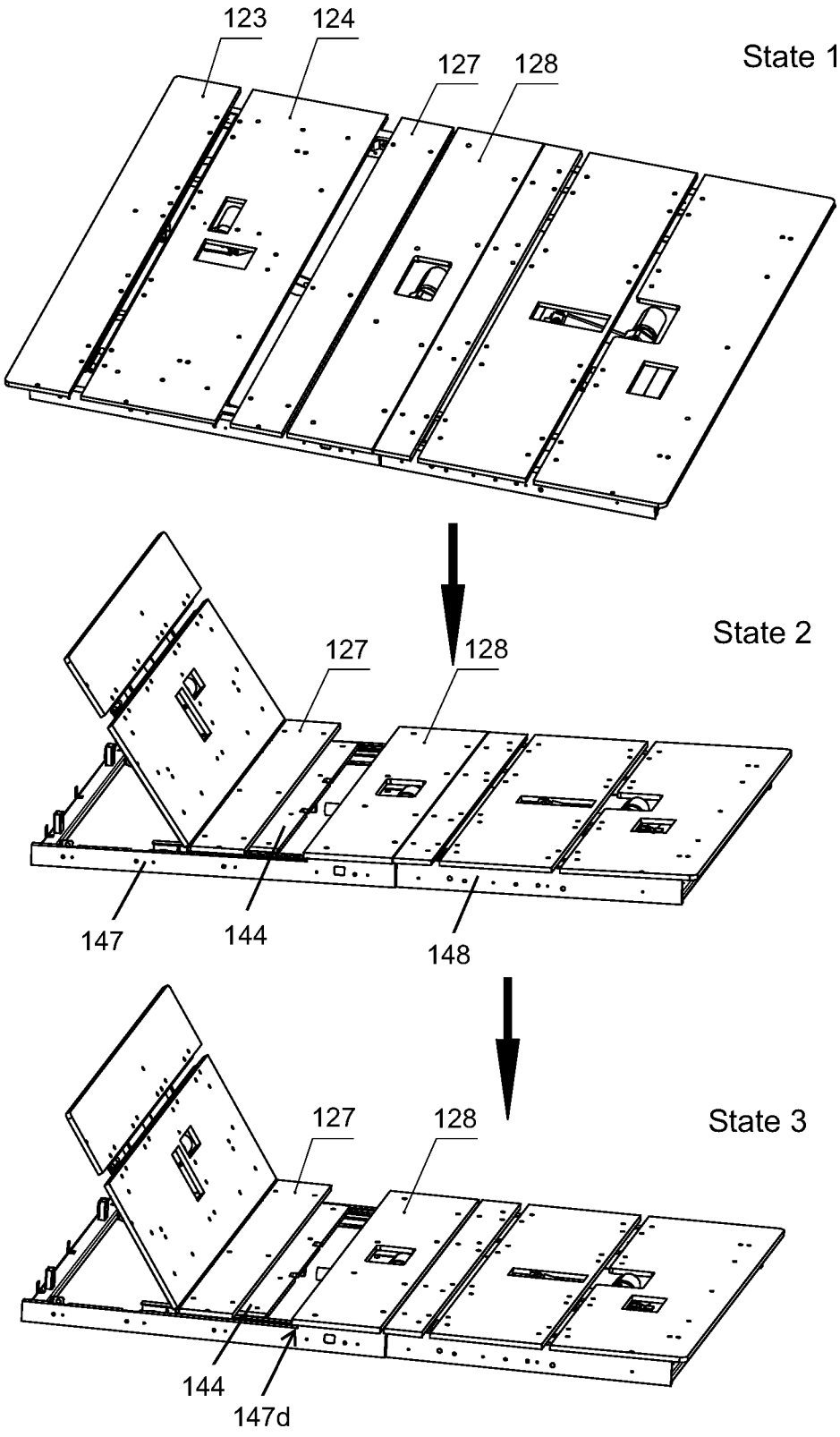
FIG. 9 shows schematically front perspective views of various operation positions/states of an adjustable bed according to another embodiment of the invention.
Figure 10:
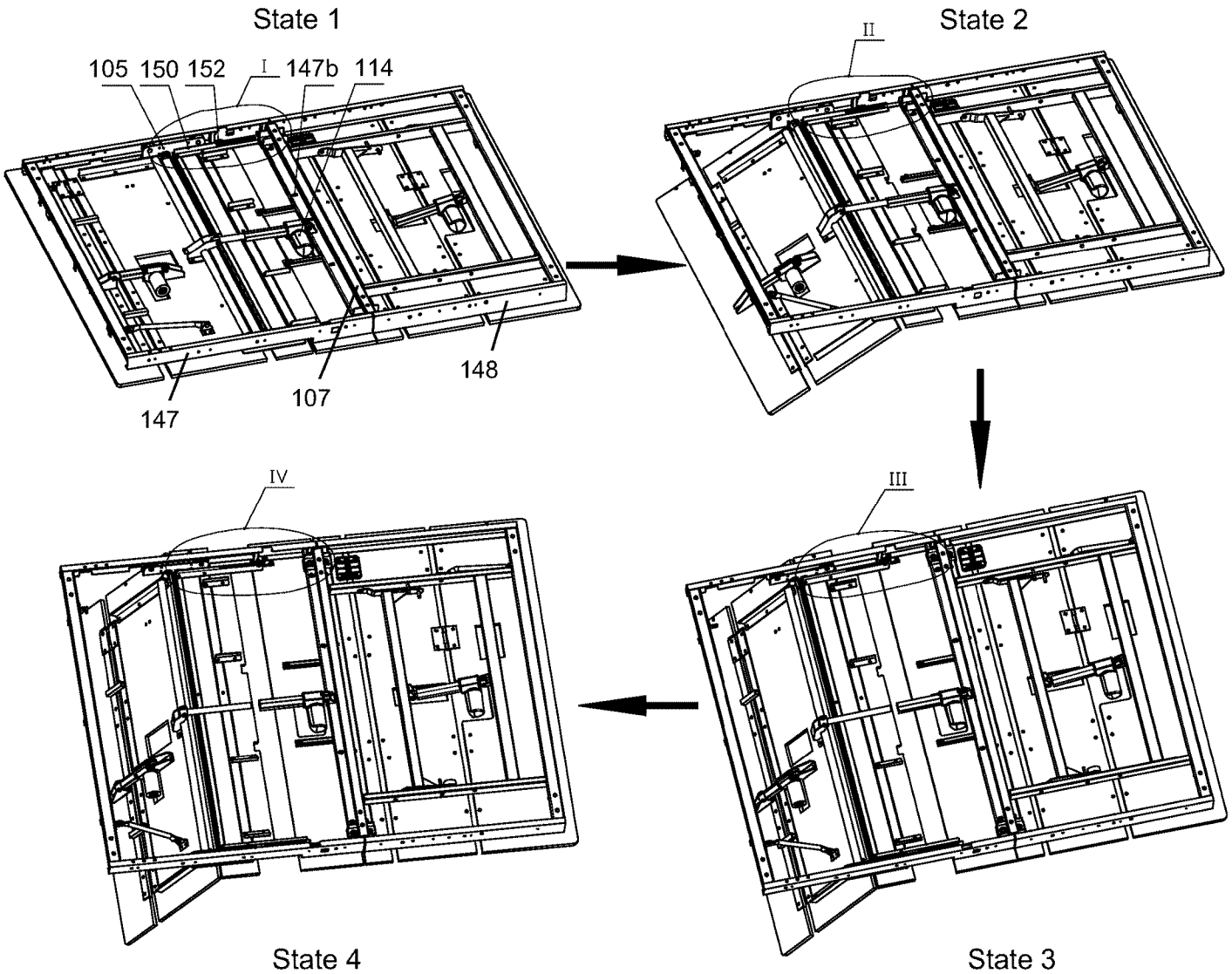
FIG. 10 shows schematically back perspective views of various operation positions/states of the adjustable bed shown in FIG. 9.

The adjustable bed further includes a head lift motor 114. The head lift motor 114 is secured to the head frame assembly 147 for driving the pair of head lift arm bracket assemblies 102 in a head lift forward direction (i.e., the head lift arm bracket assemblies 102 are lifted at States 2-4, as shown in FIGS. 9, 10 and 12) or a head lift backward direction (i.e., the head lift arm bracket assemblies 102 are laid back at State 1, as shown in FIGS. 9 and 10). The term "State 1", "State 2", "State 3" or "State 4", used in the disclosure, refers to a specific position or state of the adjustable bed.

When the head lift motor 114 drives the pair of head lift arm bracket assemblies 102 in the head lift forward direction, because of the head support tube 119, the first slidable assembly 105 slides in the slidable assembly upward direction. When the head lift motor 114 drives the pair of head lift arm bracket assemblies 102 in the head lift backward direction, because of the head support tube 119, the first slidable assembly 105 slides in the slidable assembly downward direction and the support platform 144 is partially beneath the lower seat platform 128.

In other words, when the head lift motor 114 drives the pair of head lift arm bracket assemblies 102 in the head lift forward direction, the head lift platform 124 is lifted, and in the meantime, the upper seat platform 127 and the lower seat platform 128 are gradually separated by a gap, therefore extending the length of the adjustable bed. As the slidable assembly 105 slides in the slidable assembly upward direction, the support platform 144 slides as well for supporting the person when the upper seat platform 127 and the lower seat platform 28 are gradually separated. The maximum gap between the upper seat platform 127 and the lower seat platform 128 is up to the design and has no limitation to the invention. In one embodiment, the maximum gap may be up to 12 inches, preferably, up to 6.5 inches. In some embodiments, when the upper seat platform 127 and the lower seat platform 128 are separated to certain extent, for example, 6.5 inches, the person who is lying on the adjustable bed may not feel that his/her abdomen is pressed because the length of the adjustable bed is extended when the upper portion is lifted.

On the other hand, when the head lift motor 114 drives the pair of head lift arm bracket assemblies 102 in the head lift backward direction, the head lift platform 124 is laid back, and in the meantime, the upper seat platform 127 and the lower seat platform 128 are gradually coming closer to each other. Because the support platform 144 is beneath the lower seat platform 28 in terms of height, the support platform 144 is partially beneath the lower seat platform 128. When the head lift motor 114 drives the pair of head lift arm bracket assemblies to a fully laid back position (State 1) as shown in FIG. 9-10, the support platform 44 is entirely beneath the lower seat platform 128, and the lower ends of the pair of slidable assembly sides 105*b* is proximate to, or in contact with, the step 147*d* defined by the lower C steel brackets 141 and the higher C steel brackets 142.

In addition, the adjustable bed further includes at least one second slidable assembly, as illuminated by numeral 180 in FIGS. 12-13, for providing further support along with the support platform 144, and further extending the length of the adjustable bed. Each second slidable assembly is coupled with the first slidable assembly 105 and the lower seat platform 128. As shown in FIG. 13, each second slidable assembly includes a spacing bracket 150 having an upper end portion mounted on the slidable assembly base 105*a* of the first slidable assembly 105 and a lower end portion including a long guiding slot 152 formed therein. The spacing bracket 150 is installed proximately to and parrellelly to the slidable assembly side 105*b* of the first slidable assembly 105, such that when the first slidable assembly 105 moves, the spacing bracket 150 also moves accordingly. Each second slidable assembly also includes a fixing bracket 154 mounted on the lower seat platform 128, and a bolt or connection pin 156 having one end mounted on the fixing bracket 154 and another end received in the long guiding slot 152 of the spacing bracket 150. Furthermore, as shown in FIG. 13, the higher C steel brackets 142 of the pair of head frame side rails 147*c* includes an oblong hole 147*e* formed on the top of the C steel brackets 142. The lower seat platform 128 is attached onto the higher C steel brackets 142 of the pair of head frame side rails 147*c* by placing a mounting bolt 160 through the oblong hole 147*e*, such that the lower seat platform 128 is movable along the slidable assembly upward direction or the slidable assembly downward direction. The moving distance of the lower seat platform 128 is limited by the length of the oblong hole 147*e*.

Figure 11:
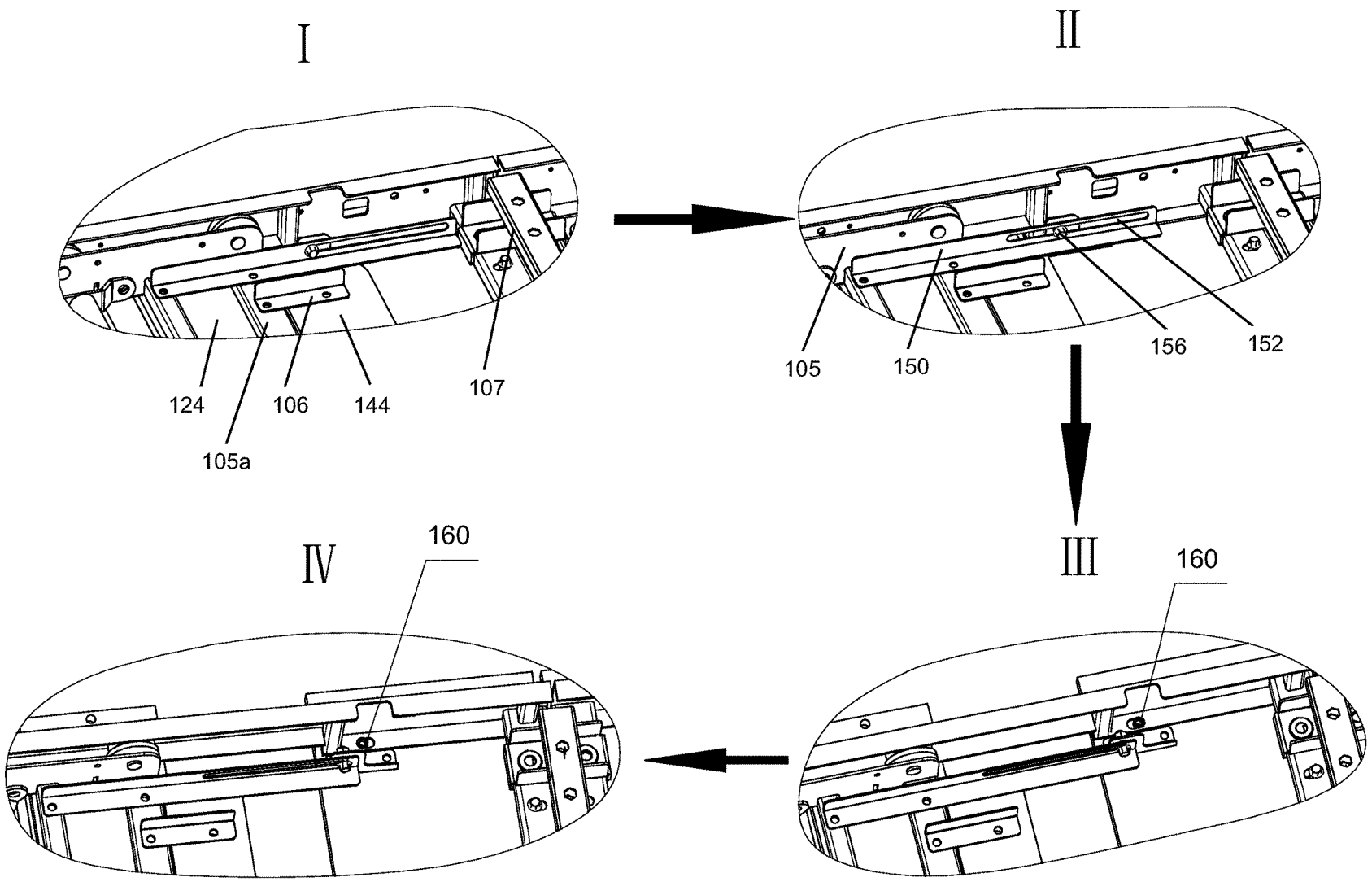
FIG. 11 shows schematically partially back perspective views of various operation positions/states of the adjustable bed shown in FIG. 9.

As such an arrangement, when the adjustable bed is in the laid back position or State 1, as shown in FIGS. 9-11, the lower ends of the pair of slidable assembly sides 105*b* of the first slidable assembly 105 is proximate to, or in contact with, the step 147*d* defined by the lower C steel brackets 141 and the higher C steel brackets 142, the lower end of the spacing bracket 150 of the second slidable assembly is proximate to, or in contact with, the knockdown connecting bracket 107, the bolt 156 of the second slidable assembly is positioned against the upper end of the long guiding slot 152 of the spacing bracket 150, and the mounting bolt 160 is positioned against the lower end of the oblong hole 147*e* on the higher C steel brackets 142 of the pair of head frame side rails 147*c*.

When the head lift motor 114 drives the pair of head lift arm bracket assemblies 102 in the head lift forward direction, the first slidable assembly 105 moves along the slidable assembly upward direction, the head lift platform 124 is lifted, and the spacing bracket 150 co-moves along the slidable assembly upward direction as well, where the bolt 156 of the second slidable assembly is positioned between the upper end and the lower end of the long guiding slot 152 of the spacing bracket 150, and the mounting bolt 160 is positioned against the lower end of the oblong hole 147*e*. In the meantime, the upper seat platform 127 and the lower seat platform 128 are gradually separated by a gap (e.g., State 2 in FIGS. 9-11), therefore extending the length of the adjustable bed.

As the first slidable assembly 105 is driven to further move along the slidable assembly upward direction, the spacing bracket 150 co-moves along the slidable assembly upward direction so that the bolt 156 of the second slidable assembly is positioned against the lower end of the long guiding slot 152 of the spacing bracket 150, and the mounting bolt 160 is still positioned against the lower end of the oblong hole 147*e* as shown in Sate 3 in FIGS. 9-11.

Further driving the first slidable assembly 105 to move along the slidable assembly upward direction causes the mounting bolt 160 to move in the oblong hole 147*e* from the lower end to against the upper end, there resulting in the lower seat platform 28 to move along the slidable assembly upward direction by the distance defined by the length of the oblong hole 147*e*, as shown in State 4 in FIGS. 10-11 and 13.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An adjustable bed, comprising:

a head frame assembly, having a head frame upper rail, a head frame lower rail, and a pair of head frame side rails, each head frame side rail having a lower C steel bracket at a upper end and a higher C steel bracket at a lower end, and the higher C steel bracket having an oblong hole formed on its top;

a first slidable assembly having a slidable assembly base and a pair of slidable assembly sides, each of the pair of slidable assembly sides being slidable within one of the pair of lower C steel brackets in a slidable assembly upward direction or a slidable assembly downward direction;

a pair of head lift arm bracket assemblies, an lower end of each head lift arm bracket assembly being pivotally connected to one of the pair of slidable assembly sides; and a head lift platform mounted on the pair of head lift arm bracket assemblies, an upper seat platform mounted on the first slidable assembly, and a lower seat platform attached onto the higher C steel bracket of one of the pair of head frame side rails by a mounting bolt through the oblong hole such that the lower seat platform is movable relatively to the higher C steel bracket along the slidable assembly upward direction or the slidable assembly downward direction; and at least one second slidable assembly having a spacing bracket, a fixing bracket and a connecting bolt, the spacing bracket having an upper end portion mounted on the slidable assembly base of the first slidable assembly and an lower end portion having a guiding slot formed therein, and the fixing bracket being mounted on the lower seat platform, and the connecting bolt being mounted on the fixing bracket and received in the guiding slot of the spacing bracket; and a head lift motor secured to the head frame assembly for operably driving the pair of head lift arm bracket assemblies in a head lift forward direction or a head lift backward direction, wherein when the head lift motor drives the pair of head lift arm bracket assemblies in the head lift forward direction, the first slidable assembly slides in the slidable assembly upward direction, and when the head lift motor drives the pair of head lift arm bracket assemblies in the head lift backward direction, the first slidable assembly slides in the slidable assembly downward direction.

2. The adjustable bed of claim 1, wherein when the head lift motor drives the pair of head lift arm bracket assemblies in the head lift forward direction, the first slidable assembly slides in the lower C steel bracket in the slidable assembly upward direction to lift the head lift platform, and the spacing bracket of the second slidable assembly co-moves with the first slidable assembly in the slidable assembly upward direction such that the connecting bolt of the second slidable assembly is positioned from an upper end to an lower end of the guiding slot of the spacing bracket, and the mounting bolt is positioned from a lower end to an upper end of the oblong hole, and the upper seat platform and the lower seat platform are separated by a gap.

3. The adjustable bed of claim 2, wherein when the head lift motor drives the pair of head lift arm bracket assemblies in the head lift backward direction, the first slidable assembly slides in the lower C steel bracket in the slidable assembly downward direction to put down the head lift platform, and the spacing bracket of the second slidable assembly co-moves with the first slidable assembly in the slidable assembly downward direction such that the connecting bolt of the second slidable assembly is positioned from the lower end to the upper end of the guiding slot of the spacing bracket, and the mounting bolt is positioned from the upper end to the lower end of the oblong hole, and the upper seat platform and the lower seat platform are closed to each other.

4. The adjustable bed of claim 1, further comprising:

a support platform, mounted on the slidable assembly base of the first slidable assembly so that the support platform operably co-moves with the first slidable assembly, wherein the support platform is beneath the upper seat platform and the lower seat platform.

5. The adjustable bed of claim 1, further comprising:

a head support tube having an upper end pivotally connected to the head frame upper rail of the head frame assembly and a lower end connected to the head lift platform.

6. The adjustable bed of claim 5, further comprising:

a head tilt platform pivotally connected to the head lift platform; and a head tilt motor secured to the head lift platform for driving the head tilt platform in a head tilt forward direction or a head tilt backward direction.

7. The adjustable bed of claim 6, further comprising:

one or more of a first opening in the lower seat platform to accommodate the head lift motor, and a second opening in the head lift platform to accommodate the head tilt motor.

8. The adjustable bed of claim 1, further comprising:

a first massage motor opening hole in the head lift platform to accommodate a massage motor.

9. The adjustable bed of claim 1, further comprising:

a plurality of rolling wheels attached to the pair of slidable assembly sides to roll within one of the pair of lower C steel brackets in the slidable assembly upward direction or the slidable assembly downward direction.

10. The adjustable bed of claim 1, further comprising:

a foot frame assembly, having a foot frame upper rail, a foot frame lower rail, and a pair of foot frame side rails; and a knockdown connecting bracket connecting the head frame lower rail of the head frame assembly and the foot frame upper rail of the foot frame assembly.

11. The adjustable bed of claim 10, further comprising:

a pair of foot lift arm bracket assemblies, each foot lift arm bracket assembly having a first end pivotally connected to the foot frame assembly and a second end;

a fixed platform mounted on the pair of foot frame side rails;

a thigh platform mounted on the pair of foot lift arm bracket assemblies;

a leg platform, hinged with the thigh platform through a hinge;

a foot lift motor secured to the foot frame assembly for driving the pair of foot lift arm bracket assemblies in a foot lift forward direction or a foot lift backward direction; and a foot support tube having an upper end pivotally connected to the foot frame assembly and a lower end connected to the leg platform.

12. The adjustable bed of claim 11, wherein the second end of each foot lift arm bracket assembly is provided with a roller for moveably supporting the thigh platform.

13. The adjustable bed of claim 11, wherein each of the pair of foot frame side rails has a higher C steel bracket.

14. The adjustable bed of claim 11, further comprising:

one or more of a third opening in the leg platform and a fifth opening in the thigh platform to accommodate the foot lift motor.

15. The adjustable bed of claim 11, further comprising:

a second massage motor opening hole in the leg platform to accommodate a massage motor.

* * * * *